US006561329B2

(12) United States Patent
Stobbs, II et al.

(10) Patent No.: US 6,561,329 B2
(45) Date of Patent: May 13, 2003

(54) ATHLETIC EQUIPMENT BAG

(75) Inventors: Charles K. Stobbs, II, Hillsboro, OR (US); Christopher M. Helmsworth, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/835,982

(22) Filed: Apr. 16, 2001

(65) Prior Publication Data

US 2002/0148741 A1 Oct. 17, 2002

(51) Int. Cl.[7] ..... A45C 3/00

(52) U.S. Cl. ..... 190/112; 190/107; 206/315.1

(58) Field of Search ..... 383/16, 22, 23, 383/31, 38, 39, 66, 104; 190/107, 110–112, 901, 902; 206/315.1, 315.9; 150/112–114

(56) References Cited

U.S. PATENT DOCUMENTS

| | | | | |
|---|---|---|---|---|
| 782,047 A | | 2/1905 | Pearson | |
| 1,203,095 A | | 10/1916 | Bristow | |
| 1,368,523 A | * | 2/1921 | Panyity | 190/111 |
| 2,413,465 A | * | 12/1946 | Ohnsen | 132/314 |
| 2,585,745 A | | 2/1952 | Crosby | |
| 3,115,959 A | | 12/1963 | Jaffe | |
| 4,170,282 A | | 10/1979 | Schwartzstein | |
| 4,210,186 A | | 7/1980 | Belenson | |
| 4,212,377 A | * | 7/1980 | Weinreb | 190/109 |
| 4,301,898 A | | 11/1981 | Plough et al. | |
| 4,378,866 A | | 4/1983 | Pelavin | |
| 4,506,769 A | | 3/1985 | Franco et al. | |
| 4,546,863 A | | 10/1985 | Kaufman | |
| 4,595,226 A | | 6/1986 | Wessel | |
| 4,629,065 A | | 12/1986 | Braaten | |
| 4,643,302 A | | 2/1987 | Baumgardner | |
| 4,655,343 A | | 4/1987 | Lane et al. | |
| 4,657,135 A | | 4/1987 | Kjose | |
| 4,693,402 A | | 9/1987 | Comeau | |
| 4,752,008 A | | 6/1988 | Pratt | |
| 4,753,329 A | | 6/1988 | Choy | |
| 4,781,277 A | | 11/1988 | Lim | |
| 4,793,532 A | | 12/1988 | Cash | |
| 4,805,748 A | | 2/1989 | Gerch | |
| 4,805,749 A | | 2/1989 | Gerch | |
| 4,817,802 A | | 4/1989 | Pratt | |
| 4,830,154 A | | 5/1989 | Gerch et al. | |
| 4,842,032 A | | 6/1989 | Mastronardo | |
| 4,854,432 A | | 8/1989 | Carpenter et al. | |
| 4,890,731 A | | 1/1990 | Mroz | |
| 4,899,887 A | | 2/1990 | Cachero | |
| 4,984,662 A | | 1/1991 | Jacober | |
| 4,995,436 A | | 2/1991 | Cantor | |
| 5,042,664 A | | 8/1991 | Shyr et al. | |

(List continued on next page.)

FOREIGN PATENT DOCUMENTS

| | | |
|---|---|---|
| DE | 39 34 760 A 1 | 4/1991 |
| FR | 2 653 312 A3 | 4/1991 |
| WO | WO 90/08631 | 8/1990 |

OTHER PUBLICATIONS

Clelments et al., Pub. No. US 2001/0035319, Nov. 2001.*

*Primary Examiner*—Lee Young
*Assistant Examiner*—Lien TM Ngo
(74) *Attorney, Agent, or Firm*—Banner & Witcoff, Ltd.

(57) ABSTRACT

An athletic equipment bag is disclosed defining a rear wall, a forward wall, first and second side walls, and top and bottom ends. The bag includes a plurality of compartments which extend the length of the bag for storage of the athlete's equipment and gear. The bag also includes a side flap attached to one of the side walls extending the length of the bag. The side flap encloses smaller pockets or pouches that are located on the side wall and also forms an elongated side compartment that extends the length of the bag. Located within one of the compartments is a flexible, lightweight, and foldable divider that serves as a shelf when the bag is hung vertically on a fence.

57 Claims, 5 Drawing Sheets

U.S. PATENT DOCUMENTS

| | | | | |
|---|---|---|---|---|
| 5,090,526 | A | | 2/1992 | Jacober |
| 5,224,602 | A | | 7/1993 | Bettles et al. |
| RE34,361 | E | | 8/1993 | Pratt |
| 5,265,719 | A | | 11/1993 | Wand |
| 5,413,199 | A | | 5/1995 | Clement |
| 5,427,453 | A | | 6/1995 | Cloessner |
| 5,560,476 | A | | 10/1996 | Lee |
| 5,588,529 | A | | 12/1996 | Speck |
| 6,009,995 | A | | 1/2000 | Speck |
| 6,039,474 | A | * | 3/2000 | DeChant ..... 190/109 |

* cited by examiner

ATHLETIC EQUIPMENT BAG

FIELD OF THE INVENTION

The present invention relates in general to athletic equipment bags, and more particularly, to athletic equipment bags that include multiple elongated storage compartments and flexible dividers.

BACKGROUND OF THE INVENTION

Athletic equipment bags are becoming increasingly popular in numerous sports because of their functionality and attractiveness to athletes. Known athletic equipment bags are becoming more lightweight and flexible to provide easier transport of the athlete's equipment, clothing, and other gear. In the sport of baseball or softball, for example, known athletic equipment bags typically include two compartments, one for baseball bats and the other for the player's uniform and gear. Some of these bags include clips for hanging the bag in an upright vertical position on a chain-link fence to keep the bag off of the ground. Once the bag is hung on the fence, however, the player's uniform and gear in the single compartment shift to the bottom of the bag. This has the undesirable effect of mixing the player's uniform and gear together making it difficult for the player to locate smaller items stored in the compartment.

In an effort to rectify this problem, some known bags are now made with rigid shelves within the compartment to help organize and separate the ball player's gear within the bag when the bag is hung vertically. These rigid shelves, however, are inflexible and add weight to the bag. Moreover, these known bags only partially assist with the organization of the player's gear. That is, the known bags do not provide for the organized storage of the player's smaller items which are mixed with the larger items on the rigid shelves. The present invention overcomes these and other known disadvantages with existing athletic equipment bags.

BRIEF SUMMARY OF THE INVENTION

Accordingly, it is an object of the present invention to provide an athletic equipment bag that provides multiple large and small storage compartments for the segregation of all the player's equipment and gear regardless of size. It is another object to provide an athletic equipment bag that provides for easy access to those compartments. A further object of the invention is to provide an athletic equipment bag that includes flexible, lightweight, perimeter-reinforced dividers that also serve as storage shelves when the bag is hung vertically. Yet another object is to provide an athletic equipment bag that includes a side flap that encloses smaller compartments located on the side wall of the bag and that also forms a large storage compartment extending the length of the bag.

In an exemplary embodiment, the present invention includes an athletic equipment bag that has a bag enclosure which defines a rear wall, a forward wall, first and second side walls, and top and bottom ends. The bag further includes a plurality of compartments which extend the length of the bag for storage of larger equipment and gear. Located within one of these compartments is a flexible, lightweight, perimeter-reinforced divider that provides for better organization within the bag and that also serves as a storage shelf when the bag is hung in a vertical, upright position. The bag also includes a side flap attached to one of the side walls extending the length of the bag. The side flap forms an elongated compartment which extends the length of the bag and also serves as a cover for smaller compartments or pouches that are located on the side wall. A handle and a shoulder strap are also located on the bag to provide easy transport of the bag.

The full range of objects, aspects and advantages of the invention are only appreciated by a full reading of this specification and a full understanding of the invention. Therefore, to complete this specification, a detailed description of the invention follows, after a brief description of the drawings.

BRIEF DESCRIPTION OF THE DRAWINGS

The detailed description of the invention will be described in relation to the accompanying drawings. In the drawings, the following figures have the following general nature.

DETAILED DESCRIPTION OF THE INVENTION

Figure 1:
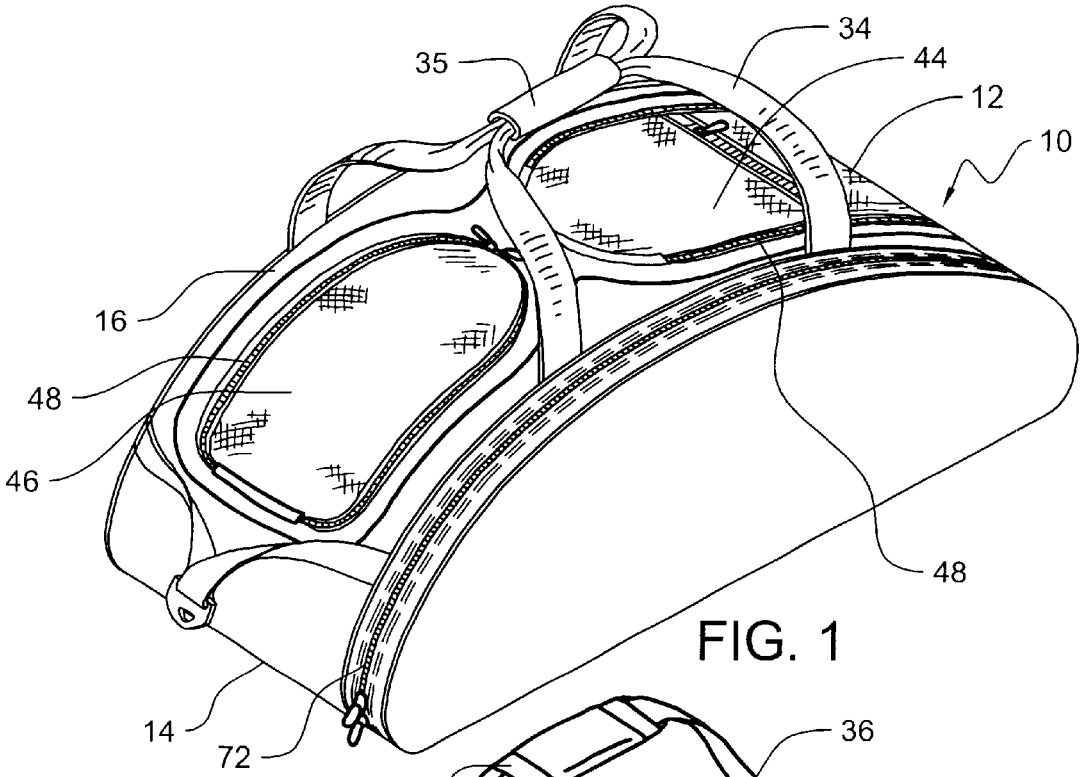
FIG. 1 is an isometric view of the athletic equipment bag of the present invention.

Referring to the Figures wherein like numerals indicate like elements, there is shown an athletic equipment bag 10 in accordance with the present invention. The bag 10 defines generally a top 12, a bottom 14, a front wall 16, a back wall 18, an interior wall 20, and opposing side walls 22, 24. As depicted, the bag 10 also defines generally a plurality of storage compartments that extend the entire length of the bag. Interior compartment 26 is formed by the interior wall 20, the opposing side walls 22, 24, and the front wall 16. Interior compartment 28 is formed by the back wall 18 and interior wall 20. Exterior compartment 30 is formed by the side wall 22 and a compartment flap 32. The bag 10 of the present invention may be made from a flexible and durable material such as nylon, or any other suitable material that provides flexibility and durability.

Figure 2:
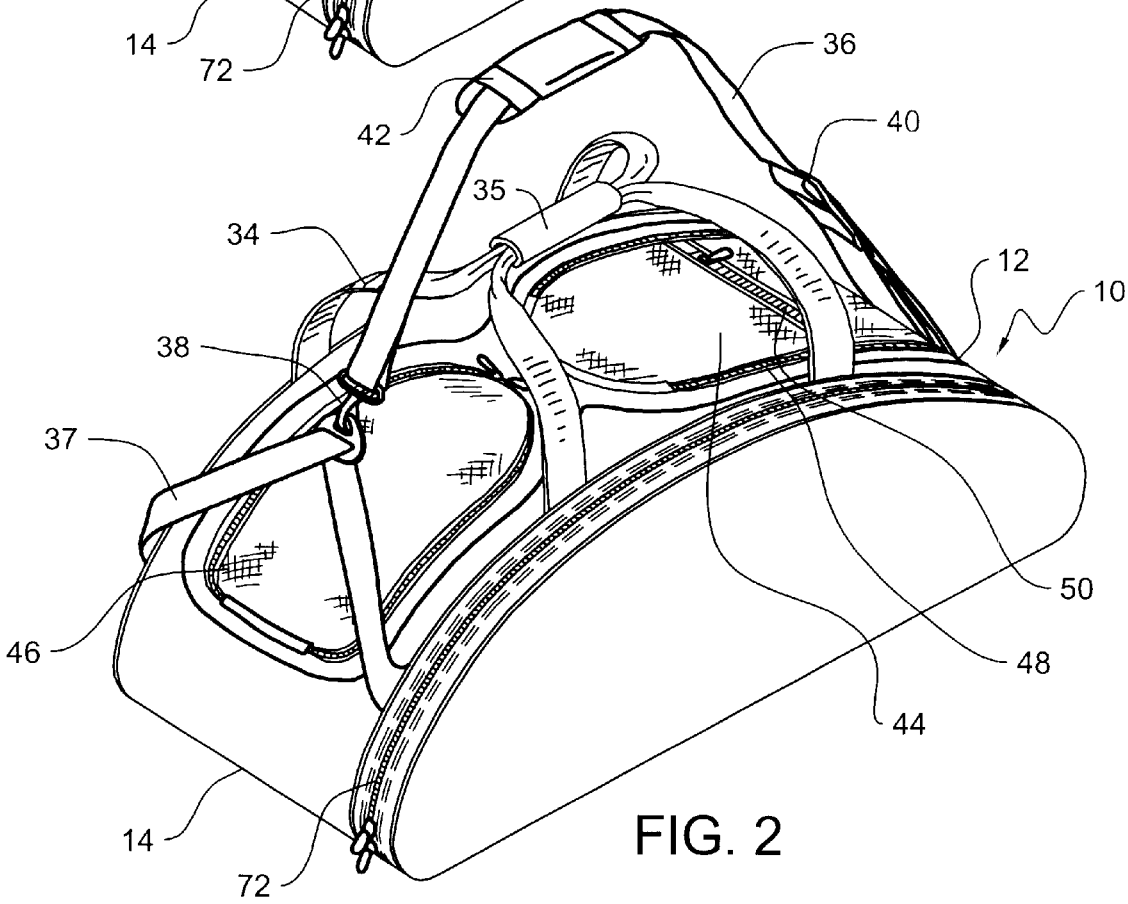
FIG. 2 is an isometric view of the bag of FIG. 1 with an attached shoulder strap.

The bag 10 includes carrying handles 34 which are straps that extend from the back wall 18, along the opposing side walls 20, 22, and beyond the front wall 16 of the bag. As conventional, the carrying handles are sewn to the back and side walls of the bag. As shown in FIGS. 1 and 2, the carrying handles 34 may be positioned adjacent to each other and through the use of a wrap 35 can be held together to provide a comfortable carrying handle. The wrap is a flexible material that surrounds the handles 34 and is secured at each end by Velcro, snap fasteners or any other suitable means for securing the ends of the flexible material. The bag 10 farther includes a shoulder strap 36 that is secured near the top end 12 and bottom end 14 of the bag via strap handles 37, which are sewn to the side walls of the bag. The shoulder strap 36 includes clips 38 which permit the removable attachment of the strap 36 to the strap handles 37. The shoulder strap 36 further includes a buckle 40 located on the strap 36 for selective adjustment of the length of the strap 36, and a slidable shoulder pad 42 for added comfort on the player's shoulder when carrying the bag.

As depicted in the Figures, the interior compartment 26 extends the entire length of the bag to form the primary storage compartment in the bag. Referring to FIGS. 1 and 2, located on the front wall 16 of the bag are outer flaps 44, 46 which form plural openings into the compartment 26 to permit access to the interior of the compartment. The outer flaps may be a mesh material to permit the player to see into the interior pocket and to serve as an air vent, or a solid flexible nylon material. The outer flaps 44, 46 are joined at one end to the front wall 16. The remainder of the periphery of the flap is a closure 48, preferably a zipper. It will be understood by those of skill in the art that other closures may be used, including snap fasteners and Velcro. Located on the interior and exterior walls of the flaps may be additional pockets 50 to provide additional storage.

Figure 4:
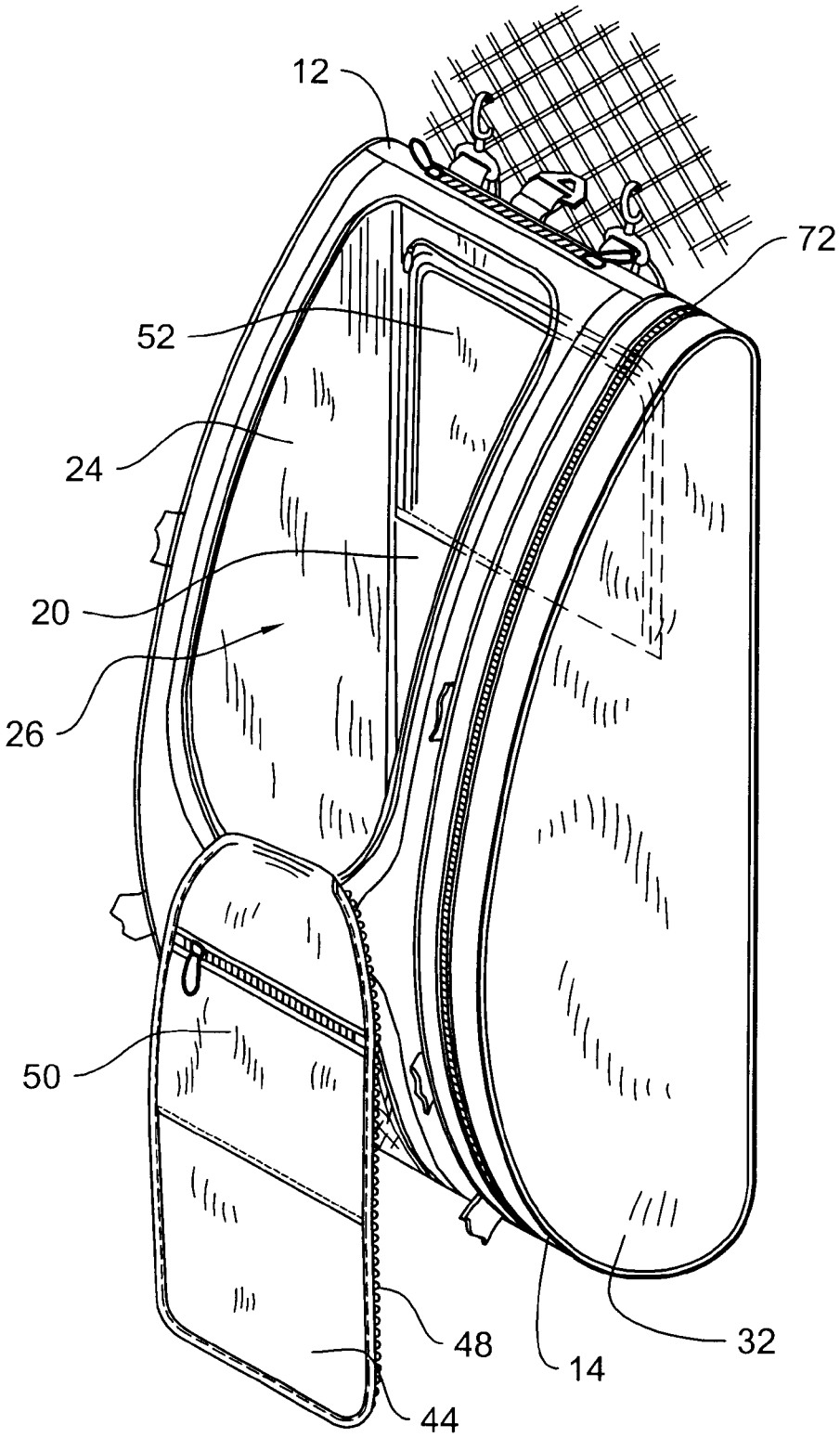
FIG. 4 is an isometric view of the bag of FIG. 1 showing the inside of one of the bag compartments.
Figure 5:
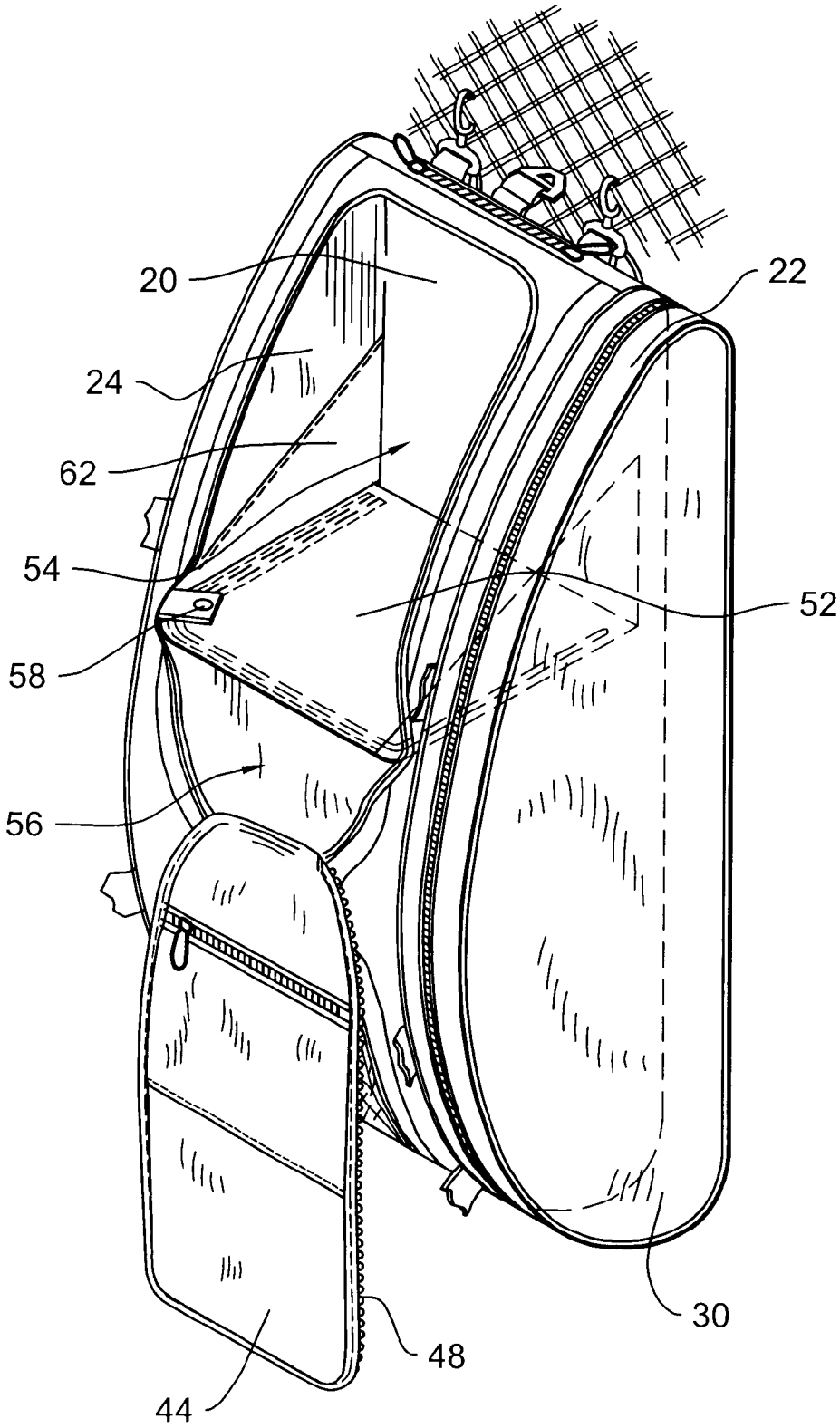
FIG. 5 is an isometric view of the bag of FIG. 1 showing the flexible divider as a shelf when the bag is hung vertically.

Referring to FIGS. 4 and 5, located within the compartment 26 is a foldable divider 52 that, when the bag is mounted in an upright position, serves as a shelf on which a player can place gear or equipment. The divider 52 creates compartments 54, 56 within the compartment 26. The foldable divider 52 is made of a flexible material and is attached on one side to the interior wall 20 of the bag. The divider is removably attached at its periphery to the side walls of the bag. In an exemplary embodiment, snap fasteners 58 are located on the divider periphery to removably attach the divider to the side walls of the bag. It should be understood that other means for removably attaching the divider to the side walls or the front wall may be used with the present invention. When the divider 52 is not attached to the side walls, the divider 52 is foldable into a horizontal position thereby creating a single compartment in the compartment 26.

The divider 52 of the invention is a wire-reinforced soft divider with a support wire located along the periphery of the divider to provide structural support to the divider. When the bag is mounted in a vertical position and the divider serves as a shelf, the wire reinforcement provides structural integrity to the divider to allow the user to place heavier objects on the divider. For additional support for the divider, a lightweight reinforcing material 62 is attached, at one end, to the periphery of the divider and, at the other end, to the interior wall 20 of the bag. The use of the wire-reinforced divider and the lightweight reinforcing material provides a storage shelf that is flexible and is of lighter weight than conventional storage shelves.

Figure 6:
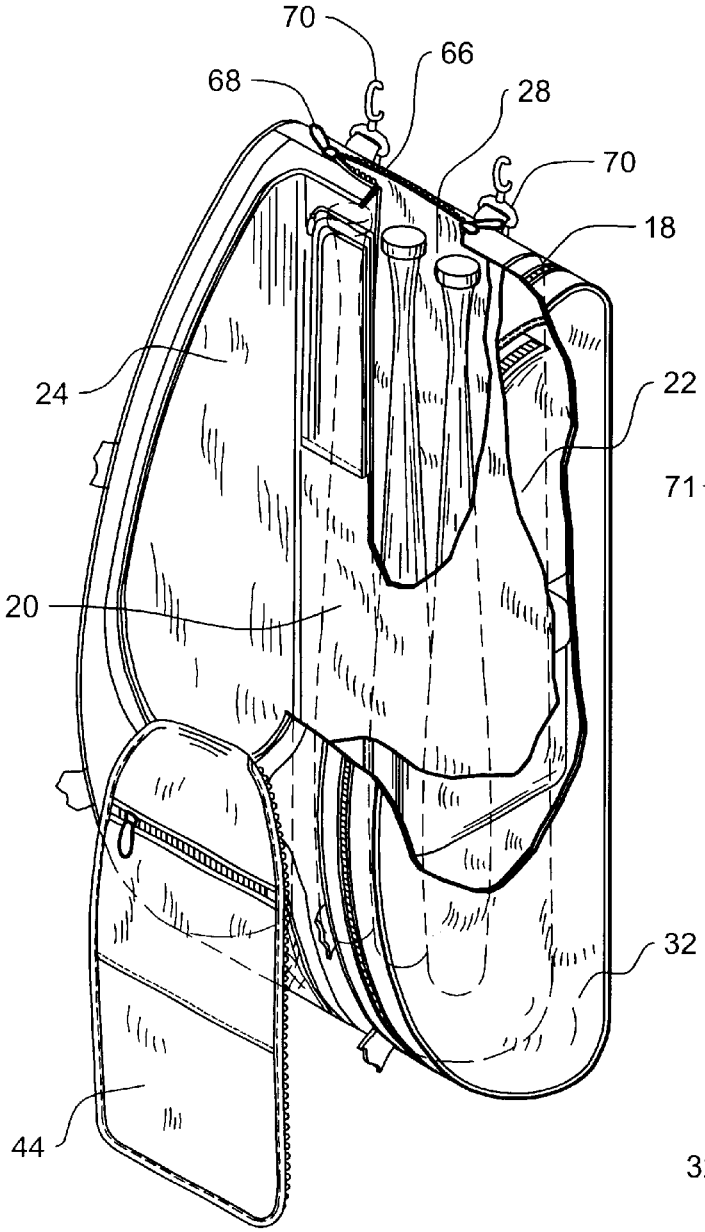
FIG. 6 is an isometric view of the bag of FIG. 1 illustrating another compartment wherein equipment, such as baseball bats, may be stored.

Referring to FIG. 6, the interior compartment 28 is formed by the interior wall 20 and the back wall 18. The interior compartment 28 extends the entire length of the bag to serve as a storage compartment for longer equipment or gear, depending on the sport. The compartment 28 has a single opening 66 at the top 12. A closure 68, such as a zipper, is located at the opening 66 to permit the opening and closing of the compartment 28. Again, it should be understood that other means for closing the opening 66 may be used with the present invention. Note also that more than one opening may be located on the bag to permit access to the compartment 28.

Also located at the top 12 of the bag near the opening 66 are clips 70 attached to the bag. The clips 70 are attached to the bag through the use of nylon straps which at one end provide a loop through which the clips are placed and, at the other end, are sewn to the bag. In use, the clips 70 permit the hanging of the bag in an upright or vertical position to a chain link fence, as depicted in FIGS. 3–5.

Figure 7:
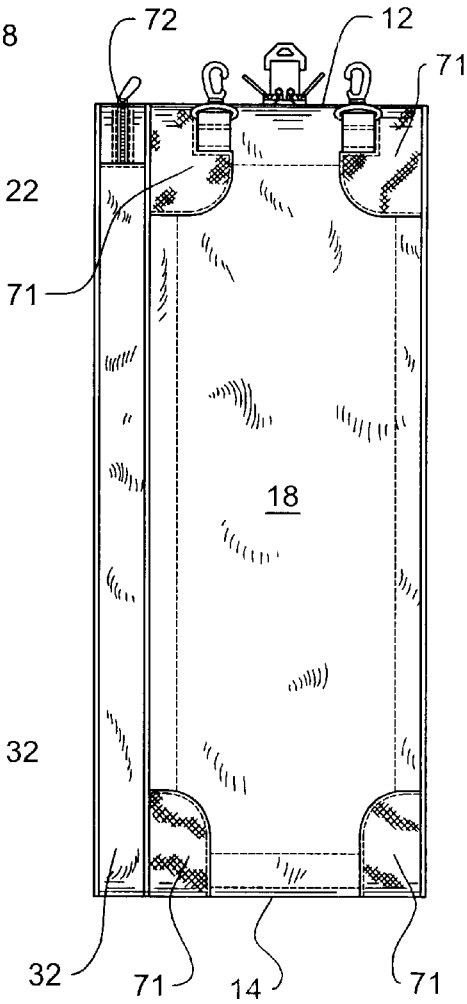
FIG. 7 is a bottom view of the bag of FIG. 1.

Referring to FIG. 7, located on the back wall 18 at each corner of the bag are wear pads 71. The wear pads 71 provide a wear surface on which the bag will rest on the ground or against a fence. The wear pads are intended to increase the longevity and preserve the durability of the bag.

Figure 3:
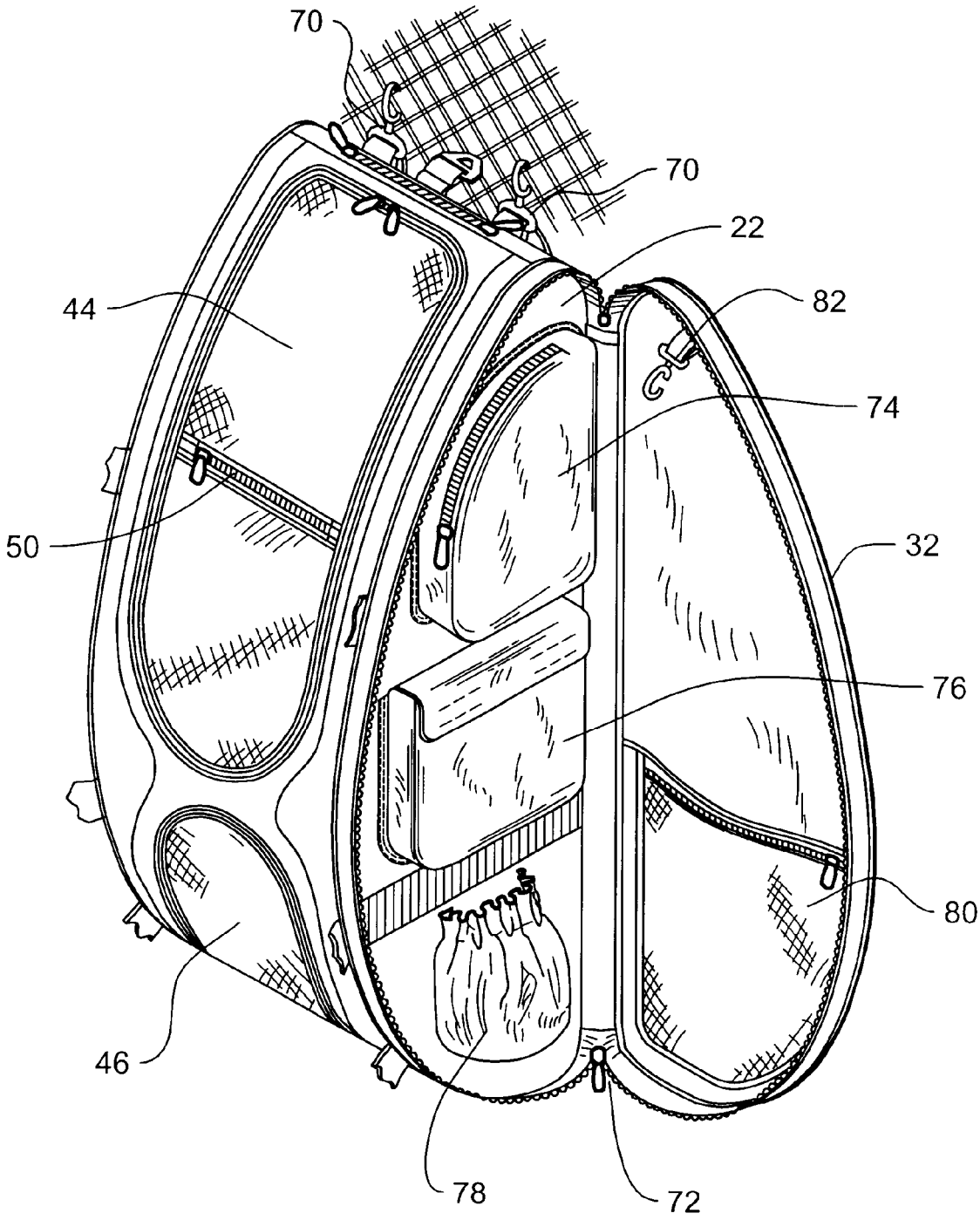
FIG. 3 is an isometric view of the bag of FIG. 1 hung vertically on a fence and depicting the side flap in an open position.

Referring to FIGS. 3 and 5, the exterior compartment 30 is formed by the side wall 22 and the compartment flap 32. The exterior compartment 30 extends the length of the bag and may be accessed through a closure 72, such as a zipper, or any other suitable closure. Located within the compartment 30 are a plurality of additional compartments 74, 76, 78, 80 for providing storage of smaller items. The compartments 74, 76, 78, 80 are located either on the side wall 22 of the bag or on the flap 32 and, as depicted, may include a closure such as a zipper, a Velcro flap, or an elastic band for providing access to the compartments. These compartments may be any shape, size and number and may be made from a solid, mesh or insulated material. These compartments may also include additional compartments for further segregation of smaller items within these small compartments. The compartment flap 32 includes a clip 82 attached to the interior wall of the compartment flap 32. The clip 82 is preferably attached to the flap 32 in the same manner as clips 70 are attached to the bag. The clip 82 may be used to attach the flap 32 to a chain-link fence to make the compartments 74, 76, 78, 80 easily accessible. The clip may also be used to attach equipment or gear to the bag.

It will be understood by those of skill in the art that variations to the embodiments are possible without being outside the scope of the present invention. Therefore, to particularly point out and distinctly claim the subject matter regarded as the invention, the following claims conclude the specification.

What is claimed is:

1. An athletic bag comprising:

a bag enclosure having an exterior and an interior, the bag enclosure defining an exterior rear wall, an exterior forward wall, a first exterior side wall, a second exterior side wall, an interior rear wall, an interior side wall, a top end, and a bottom end, a plurality of interior compartments extending from the top end to the bottom end, the plurality of interior compartments including a first compartment defined by the exterior forward wall, the first exterior side wall, the interior rear wall, and the interior side wall, a second compartment defined by the interior side wall and the second exterior side wall, and a third compartment defined by the interior rear wall and the exterior rear wall, a handle attached to the bag enclosure for transport of the athletic equipment bag, a flexible and foldable divider positioned within the first compartment, the divider defining a reinforced perimeter and including means for attaching the divider to the interior side wall and the first exterior side wall, and a plurality of pockets located within the second compartment, the plurality of pockets positioned on the interior side wall.

2. The athletic bag of claim 1 wherein the exterior forward wall includes a first exterior panel that has an open and a closed position.

3. The athletic bag of claim 2 wherein the first exterior panel forms an opening in the forward wall for access to the interior of the first compartment.

4. The athletic bag of claim 3 wherein the plurality of pockets located within the second compartment are positioned on the second exterior side wall.

5. The athletic bag of claim 4 wherein the flexible and foldable divider is attached to the interior rear wall of the bag.

6. The athletic bag of claim 5 wherein at least one clip is attached to the top end of the bag for vertically hanging the bag on a fence.

7. The athletic bag of claim 6 wherein a shoulder strap is removably attached to the top end and the bottom end of the bag.

8. The athletic bag of claim 7 wherein the exterior rear wall defines four corners, the rear wall includes wear pads located at each of the four corners.

9. The athletic bag of claim 3 wherein the first exterior panel defines an interior and an exterior wall, a interior panel pocket is located on the interior wall of the first exterior panel.

10. The athletic bag of claim 9 wherein a mesh panel pocket is located on the exterior wall of the first exterior panel.

11. The athletic bag of claim 5 wherein the exterior forward wall defines a second exterior panel.

12. The athletic bag of claim 11 wherein the second exterior panel has an open and a closed position.

13. The athletic bag of claim 12 wherein the second exterior panel forms an opening in the exterior forward wall for access to the interior of the first compartment.

14. The athletic bag of claim 13 wherein the second exterior panel is made from a mesh material to provide visible access to the interior of the first compartment.

15. The athletic bag of claim 5 wherein a reinforcing panel is attached to the first exterior side wall of the bag.

16. The athletic bag of claim 3 wherein the third compartment includes a means for access to the interior of the third compartment.

17. The athletic bag of claim 16 wherein the means for access to the interior of the third compartment is located at the top end of the bag.

18. The athletic bag of claim 1 wherein the bag enclosure includes a zipper extending from the top end to the bottom end of the bag.

19. The athletic bag of claim 18 wherein the zipper is located on the exterior forward wall between the interior side wall and the second exterior side wall, the zipper providing access to the second compartment.

20. The athletic bag of claim 19 wherein the zipper is movable from a fully open position to a filly closed position, with the zipper in the filly closed position the second exterior side wall forms the second compartment, with the zipper in the fully open position the second exterior side wall becomes a side flap.

21. The athletic bag of claim 20 wherein a clip is attached to the exterior side wall near the top end of the bag.

22. The athletic bag of claim 21 wherein the clip vertically hangs the side flap formed by the exterior side wall when the zipper is in a fully open position.

23. The athletic bag of claim 19 wherein the zipper is movable to a partially open position, with the zipper in the partially open position the second exterior side wall forms a partial side flap and a partial second compartment.

24. The athletic bag of claim 23 wherein a clip is attached to the exterior side wall near the top end of the bag, the clip vertically hangs the partial side flap from a fence.

25. An athletic bag for vertically hanging on a fence comprising:

a bag enclosure defining a rear wall, a forward wall, a first side wall, a second side wall, a top end, and a bottom end, a first compartment extending from the top end to the bottom end and defined by the forward wall, the side walls, and the rear wall, a side flap attached to the second side wall near the rear wall, the side flap extending from the top end to the bottom end of the bag, a handle attached to the bag enclosure for transport of the athletic equipment bag, a flexible and foldable divider positioned within the first compartment, the divider defining a wire reinforced perimeter and including means for attaching the divider to the side walls, and a plurality of pockets located on the second side wall.

26. The athletic bag of claim 25 wherein the bag enclosure includes an interior rear wall.

27. The athletic bag of claim 26 wherein a second compartment is defined by the rear wall and the interior rear wall, the second compartment extending from the top end to the bottom end of the bag.

28. The athletic bag of claim 25 wherein the side flap defines a perimeter, a zipper is located on the perimeter of side flap.

29. The athletic bag of claim 28 wherein the side flap includes at least one pocket.

30. The athletic bag of claim 28 wherein the forward wall includes a first exterior panel that has an open and a closed position.

31. The athletic bag of claim 30 wherein the first exterior panel forms an opening in the forward wall for access to the interior of the first compartment.

32. The athletic bag of claim 26 wherein the flexible and foldable divider is attached to the interior rear wall of the bag.

33. The athletic bag of claim 32 wherein at least one clip is attached to the top end of the bag for vertically hanging the bag on a fence.

34. The athletic bag of claim 33 wherein a shoulder strap is removably attached to the top end and the bottom end of the bag.

35. The athletic bag of claim 34 wherein the rear wall defines four corners, the rear wall includes wear pads located at each of the four corners.

36. The athletic bag of claim 35 wherein the first exterior panel defines an interior and an exterior wall, a interior panel pocket is located on the interior wall of the first exterior panel.

37. The athletic bag of claim 36 wherein a mesh panel pocket is located on the exterior wall of the first exterior panel.

38. The athletic bag of claim 37 wherein the forward wall defines a second exterior panel.

39. The athletic bag of claim 38 wherein the second exterior panel has an open and a closed position.

40. The athletic bag of claim 39 wherein the second exterior panel forms an opening in the forward wall for access to the interior of the first compartment.

41. The athletic bag of claim 40 wherein the second exterior panel is made from a mesh material to provide visible access to the interior of the first compartment.

42. The athletic bag of claim 41 wherein a reinforcing panel is attached to the first side wall of the bag.

43. The athletic bag of claim 42 wherein the second compartment includes a means for access to the interior of the second compartment.

44. The athletic bag of claim 28 wherein the zipper is movable from a fully open position to a fully closed position, with the zipper in the fully closed position the second side wall and the side flap form a third compartment.

45. The athletic bag of claim 25 wherein a clip is attached to the side flap near the top end of the bag.

46. The athletic bag of claim 28 wherein the zipper is movable to a partially open position, with the zipper in the partially open position the side flap forms a partial third compartment.

47. An athletic bag for vertically hanging on a fence comprising:

a bag enclosure defining a rear wall, a forward wall, a first side wall, a second side wall, a side flap, a top end, and a bottom end, a first compartment extending from the top end to the bottom end and defined by the forward wall, the side walls, and the rear wall, a forward wall panel attached to the forward wall for permitting access to the first compartment, a flexible and foldable divider positioned within the first compartment, the divider having a wire reinforced perimeter and including a means for attaching the divider to the side walls, and a plurality of pockets located on the second side wall, the side flap attached to the second side wall near the rear wall, the side flap extending from the top end to the bottom end of the bag to cover the plurality of pockets.

48. The athletic bag of claim 47 wherein the bag enclosure includes an interior rear wall.

49. The athletic bag of claim 48 wherein a second compartment is defined by the rear wall and the interior rear wall.

50. The athletic bag of claim 47 wherein the side flap defines a perimeter, a zipper is located on the perimeter of side flap.

51. The athletic bag of claim 50 wherein the side flap includes at least one pocket.

52. The athletic bag of claim 49 wherein the flexible and foldable divider is attached to the interior rear wall of the bag.

53. The athletic bag of claim 52 wherein a shoulder strap is removably attached to the top end and the bottom end of the bag.

54. The athletic bag of claim 53 wherein a mesh panel pocket is located on the forward wall panel.

55. The athletic bag of claim 50 wherein the zipper is movable from a fully open position to a filly closed position, with the zipper in the fully closed position the second side wall and the side flap form a third compartment.

56. The athletic bag of claim 55 wherein a clip is attached to the side flap near the top end of the bag.

57. The athletic bag of claim 50 wherein the zipper is movable to a partially open position, with the zipper in the partially open position the side flap forms a partial third compartment.

* * * * *